United States Patent [19]

Watson et al.

[11] 3,980,477

[45] Sept. 14, 1976

[54] PHOTOELECTROPHORESIS WITH DARK CHARGE INJECTING ELEMENT

[75] Inventors: P. Keith Watson, Rochester; Paul J. Cressman, Fairport; Richard V. LaDonna, Irondequoit, all of N.Y.

[73] Assignee: Xerox Corporation, Stamford, Conn.

[22] Filed: Nov. 26, 1974

[21] Appl. No.: 527,326

[52] U.S. Cl. ..... 96/1.2; 96/1 PE; 96/1.3

[51] Int. Cl.[2] ..... G03G 13/22

[58] Field of Search ..... 96/1 PE, 1.2, 1.3

[56] References Cited

UNITED STATES PATENTS

| | | | |
|---|---|---|---|
| 3,384,566 | 5/1968 | Clark | 96/1 PE X |
| 3,535,221 | 10/1970 | Tulagin | 96/1 PE X |
| 3,595,771 | 7/1971 | Weigl | 96/1.3 X |
| 3,676,313 | 7/1972 | Ciccarelli | 96/1 PE X |
| 3,775,107 | 11/1973 | Tulagin et al. | 96/1.3 X |
| 3,782,932 | 1/1974 | Tulagin | 96/1.3 |
| 3,787,206 | 1/1974 | Goffe | 96/1.2 |

*Primary Examiner*—Roland E. Martin, Jr.

*Attorney, Agent, or Firm*—James J. Ralabate; Michael H. Shanahan; Raymond C. Loyer

[57] ABSTRACT

An improved photoelectrophoretic imaging method is disclosed wherein a blocking layer is provided with a coating which interacts, in the dark, with the pigment particles of the imaging suspension so as to provide a uniformly charged imaging suspension upon exposure of the suspension to an electric field. The coating material occupies at least a substantially equal position in the Dark Charge Injection Series as any pigment in the imaging suspension. Subsequent or simultaneous electromagnetic radiation to which at least some of the particles are sensitive then results in the formation of optically positive and negative images.

18 Claims, 6 Drawing Figures

PHOTOELECTROPHORESIS WITH DARK CHARGE INJECTING ELEMENT

BACKGROUND OF THE INVENTION

This invention relates to the photoelectrophoretic imaging process and more particularly to an improved process wherein the imaging suspension is uniformly charged.

A detailed description of the photoelectrophoretic imaging process and materials and apparatus therefor appears in U.S. Pat. Nos. 3,383,993; 3,384,488; 3,384,565 and 3,384,566. The disclosures of the aforementioned patents are hereby incorporated by reference. Briefly, the photoelectrophoretic imaging process, as described in the aforementioned incorporated patents, is a method wherein a liquid suspension of electrically photosensitive particles is placed between a pair of electrodes. The particles acquire a charge when an electrical field is placed between the electrodes which charge is modified by exposure of the particles to light thus causing a light controlled deposition of the particles on one boundary of the suspension or the other. Particle movement is caused by the force exerted on the charged particles by the electric field. The light absorbed by a particle enables it to undergo a change in polarity which then determines its position in the field. One of the electrodes in the process is termed a conductive electrode which is generally a transparent conductive material and is the electrode upon which the pigments desirably rest at the time they are exposed to appropriate electromagnetic radiation. While not subscribing to any particular theory, the aforementioned patents propose that the pigments when exposed to actinic electromagnetic radiation while resting upon the conductive electrode, acquire a charge from the electrode. Upon acquisition of such charge the particle moves toward the opposite electrode. The opposite electrode is generally covered with an electrically insulating material such that when a pigment particle contacts the electrode under influence of the field it will not give up any charge and will remain against the blocking electrode. Upon separation of the electrodes there is generally provided an optically positive image on one of the electrodes and a negative image residing on the other electrode either monochromatic or polychromatic depending upon the optical input and the colors of the pigments in the imaging suspension.

As previously mentioned, the pigments in the imaging suspension have an initial charge and also can acquire an additional electrical charge upon being subjected to an electrical field between the electrodes. One of the problems encountered in the above-mentioned process relates to the polarity of the charge acquired by the pigments of any one color. For example, while about half of certain magenta pigments particles may exhibit a negative charge in the field between the electrodes while in the dark, the other half of the pigment particles will acquire the opposite charge and thus migrate immediately, in the dark, to the blocking electrode. Thus because only some of the pigment resides on the conductive electrode, the density of the resultant image on the conductive electrode is reduced by the amount of pigment deposited on the blocking electrode. Another disadvantage of this phenomenon is the unwanted deposition on the blocking electrode of such pigments in background areas thus degrading image quality of both images produced by the process.

The problem of the non-uniform charging of the pigments in the imaging suspension of the photoelectrophoretic imaging method is well known and, in fact, has been employed advantageously in the prior art. For example, a photoelectrophoretic imaging system taking advantage of the diversity of the dark charge of the pigments is disclosed in U.S. Pat. No. 3,535,221, to Tulagin. In accordance with the system disclosed therein the image sense, optical positive or optical negative, is controlled such that one may produce a positive image or a negative image on either of the blocking electrode or the conductive electrode. The method of selectively producing positive or negative copies on either electrode is achieved by providing an imaging suspension with pigment particles having a sensitivity to a first range of wavelengths and providing on the blocking layer surface a photosensitive material sensitive to a second range of wavelengths. In accordance with the disclosure of that patent an optically positive image is formed on the blocking electrode by exposing the suspension and blocking layer to light in wavelength to which only the coating on the blocking layer is sensitive. If one desires to produce an optically positive image on the conductive electrode one exposes the imaging suspension to electromagnetic radiation to which the particles of the imaging suspension are sensitive but to which the material on the blocking layer is insensitive. The positive image is formed on the blocking layer because of the diversity of charge acquired by the particles of the imaging suspension in the dark. Some of the imaging pigments are attracted to the blocking electrode to form a coating of imaging pigment particles. When the material on the blocking layer is exposed to actinic radiation the pigment particles of the suspension are repelled from the blocking layer in the exposed areas. According to the patent, the coating on the blocking layer reflects back any pigment attracted to it when the coating on the blocking layer is struck with light to which its coating is sensitive. Thus the light exposed areas will contain no pigment while there will reside on the blocking electrode in non-light struck areas a coating of imaging pigment which has taken an opposite charge to those coating the conductive electrode. When the imaging suspension is exposed with light to which it is sensitive, but to which the coating on the blocking layer is insensitive, the imaging pigments coating the conductive layer are caused to migrate to the blocking electrode in the exposed areas. There is thus produced a positive image configuration of the imaging particles on the conductive electrode.

An even more severe problem than the non-uniform charging described above exists with polychromatic images produced by the aforementioned process because the loss of varying amounts of pigments of the different colors in the suspension destroys the color balance intended to produce the desired final result.

We have discovered that certain materials, many of them being pigments previously known to be useful in the imaging suspension of the photoelectrophoretic imaging process, can be placed in a Dark Charge Injection Series. Materials in this series have the ability to inject charge into the pigments of the imaging suspension while they are both under an electrical field in the dark. Generally, those materials higher in the series have the ability to inject charges into those materials lower in the series. Typically, the material employed to inject charges into the pigments of the imaging suspension are termed "dark charge injecting materials" and are placed on the blocking layer of the photoelectrophoretic imaging system for use in that purpose.

SUMMARY OF THE INVENTION

Now in accordance with the present invention it is an object to overcome the above-noted deficiencies in the prior art photoelectrophoretic imaging process.

More specifically, it is an object of this invention to provide a photoelectrophoretic imaging process wherein all of the pigments in imaging suspension are charged to the same polarity while in the dark and prior to imagewise exposure by employing a dark charge injecting material on the blocking layer which material is in at least a substantially equal position in the Dark Charge Injection Series as the pigments in the imaging suspension.

Another object of this invention is to provide a photoelectrophoretic imaging process wherein images having improved density are produced.

Yet another object of this invention is to reduce the unwanted background material resulting from non-uniform charge acquisition of pigments in the photoelectrophoretic imaging system.

In accordance with this invention, there is provided a photoelectrophoretic imaging process wherein all of the pigments in the imaging suspension are charged, in the dark, prior to the imagewise exposure to a common polarity by means of a dark charge injecting material which is in contact with the imaging suspension. A dark charge injecting material is any material, as further described below, which will inject charge of one polarity into all the pigments of the imaging suspension. In accordance with this invention, at least one pigment of the imaging suspension occupies a substantially equal position in the Dark Charge Injection Series as the dark charge injecting material on the blocking layer. The color and spectral sensitivity of the dark charge injecting material of this invention are not critical nor need they be of the same sensitivity as the pigments in the imaging suspension. The reason for the disregard of sensitivity is because the effect of the injection occurs in the dark or, in other words, in the absence of electromagnetic radiation to which either the dark charge injecting layer or imaging suspension is sensitive.

Thus, in accordance with the method of this invention, a dark charge injecting material is provided on the blocking layer by either first coating the blocking layer by any suitable means as described herein below or including a dark charge injecting material in the imaging suspension. Prior to imagewise exposure, the imaging suspension containing the dark charge injecting material is subjected to an electric field whereby the dark charge injecting material is caused to migrate to the blocking layer where it remains because of the polarity of the charge the material acquires by being subjected to the electric field. On the blocking electrode the dark charge injecting material performs the function of charging the pigments intended for use in the imaging process to a uniform polarity. The uniform polarity to which the pigments are charged is such as to cause these pigments to deposit on the conductive electrode in the dark.

If included in the imaging suspension, the dark charge injecting material can also be employed as one of the pigments employed to produce the images. Of course, the amount of such pigment lost to the blocking layer as the dark charge injecting material is accounted for when initially preparing the imaging layer. That is, an extra amount of the dark charge injecting pigment is included in the suspension to make up for the loss due to the coating of the blocking layer prior to the exposure step of the process.

Experience with the method of this invention has shown that the polarity injected into the imaging pigments of the imaging suspension by the dark charge injecting material is that polarity which is the same as the blocking electrode. For example, if the blocking electrode has a negative polarity with respect to the conducting electrode the dark charge injecting material will cause the pigments of the imaging suspension to become negatively charged thus causing them to be attracted to the positive conductive electrode prior to the exposure step of the process of this invention.

The materials useful in the process of this invention for the purpose of causing a charge to be injected into the pigments while in the dark condition depends upon the pigments employed in the imaging suspension. Dark charge injecting materials can be classified with respect to their ability to dark charge inject so as to form a Dark Charge Injection Series by an electrometer measurement further described below. In accordance with this invention, the dark charge injecting material in contact with the imaging suspension need only be at least substantially equal in the series as any pigment employed in the imaging suspension.

Any suitable material can be employed in the process of this invention. Such materials are those which cause dark charge injection, as described above, into itself as well as other materials in substantially the same or lower positions in the Dark Charge Injection Series. One way in which to select materials useful in the process of this invention is to employ a suspension of the candidate material as an imaging layer in the above-described photoelectrophoretic imaging process. A series of images are produced so as to indicate the sensitivity and contrast capabilities of candidate materials at a series of different voltages. These data provide a series of curves by plotting the obtained image densities against the amount of exposure linearly. Then an indicative curve is obtained by plotting the initial slope of each curve produced by the voltage series against the voltage employed to produce the images. A more complete description of their procedure is found below. Typical examples of suitable materials are:

Bonadur Red B, a pigment available from Collway colors, inc., alpha phthalocyanine, 1-[1-naphthyl azo]-2-naphthol; benzo-[b]-naphtho-[2,3-d] furan-6,11-dione and dinaphtho [1,2,d;2'3;d] furan-8,13-dione.

An excess of dark charge injection into the pigments of the imaging suspension in accordance with this invention will decrease the photosensitivity of the pigments. In some cases, the decrease will be to the point of making a reasonable image exposure impractical. To regulate the amount of dark charge injection, one must regulate the amount of dark charge injection material employed on the blocking layer and if such material is highly active, then the amount is decreased so that the dark charge injection will be adequate to provide a uniformly charged imaging suspension, but will not unduly reduce the photosensitivity of the pigments.

Any candidate material can be placed in the Dark Charge Injection Series by means of a simple test. According to the test, as is more fully described below, the candidate material is coated onto a blocking electrode and mounted on a roller electrode. A thin layer of electrically insulating liquid is spread over a conductive electrode. The electrodes are then connected to a source of electrical potential in the range of about 800 to about 1000 volts and the roller passed over the conducting electrode at a speed of about 2–5 cm./second. After the roller has passed over the conductive electrode with the potential applied, the amount of charge residing on the candidate material residing on the blocking layer is measured by an electrometer.

The amount of charge remaining on the candidate material, expressed as voltage, determines the place the candidate material occupies in the Dark Charge Injection Series. The Series is arranged in terms of such voltage, with each candidate material being placed in the Series immediately above any other material providing a lower voltage in the test and below any other material providing a higher voltage value in the test.

In accordance with the above-mentioned test there is found in Table I below materials and test results providing an indication of the position of typical materials in the Dark Charge Injection Series. The test is operated at an applied voltage of 1000 volts. In general, the amount of dark charge injection increases with the thickness of the layer of candidate material. For illustrative purposes, data is shown below with the same material at three different thicknesses, each thickness providing a different result.

TABLE I

| Material Tested | Voltage |
|---|---|
| 2,3-dichloro-5,6-dicyano-1,4-benzoquinone | 960 |
| 1-[1-naphthyl azo-]-2-naphthol (1 micron thick) | 900 |
| benzo-[b]-naphtho-[2,3-d] furan-6,11 dione | 750 |
| naphtho [2,3-d] furo-[3,2-f] quinoline-8,13-dione | 560 |
| Bonadur Red B (a pigment available from Collway Colors, Inc.) | 500 |
| naphtho [2,3-d] furo-[2,3-h] quinoline-8,13-dione | 450 |
| 1-[1-naphthyl azo]-2-naphthol (.1 micron thick) | 400 |
| alpha phthalocyanine | 300 |
| dinaphtho [1,2,b; 2',3'd] furan-7,12-dione | 250 |
| dinaphtho [1,2b; 2',3'd] furan-8,13 dione | 100 |
| 1-[1-naphthyl azo]-2-naphthol (.01 micron thick) | 80 |
| Bonadur Red B* | 60 |
| N-2''-pyridyl-8,13-dioxodinaphtho-[2,1-b;2',3-d]-furan-6-carboxamide | 24 |

*The pigment is first dispersed in mineral oil at 4 grams per 100ml. About .8 grams of purified powdered polyethylene DYLT from Union Carbide Corporation is added and dissolved by heating the mixture to 105°C – 110°C. The solution is cooled thus coating the pigment particles with the polyethylene.

A unique feature of this invention is the surprising ability of the dark charge injecting material employed in accordance with this invention to inject charge prior to image exposure upon initial contact with a pigment of the imaging suspension. Subsequent contact after imagewise exposure does not appear to cause effective dark charge injection such that the pigments which are desirably attracted to the blocking electrode through the mechanism of imagewise exposure to the appropriate electromagnetic radiation are not repelled by dark charge injection from the blocking layer. No theoretical explanation is presented to account for the behavior of the dark charge injection materials or the mechanism of the process of the present invention.

Although this invention has been described with respect to the photoelectrophoretic imaging process, it is equally applicable to the electrophoretic imaging process. Because the dark charge injection does not require actinic electromagnetic radiation the electrophoretic imaging process can be advantageously employed with a dark charge injecting material on the blocking layer. Thus typical prior art electrophoretic systems incorporating the dark charge injecting materials as described herein with respect to the photoelectrophoretic imaging process is within the scope of this invention.

BRIEF DESCRIPTION OF THE DRAWINGS

The invention may be further understood upon reference to the drawings which show a schematic representation of apparatus for performing the improved photoelectrophoretic imaging process of this invention.

DETAILED DESCRIPTION OF THE DRAWINGS

Figure 1:
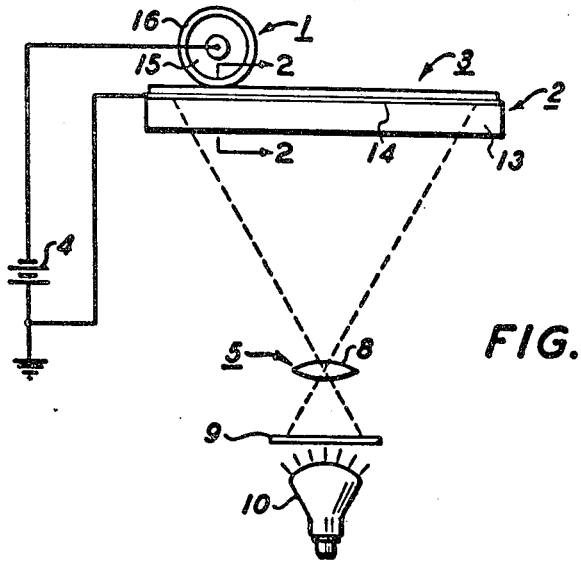
FIG. 1 is a schematic, side elevation view of a photoelectrophoretic imaging system.

FIG. 1 illustrates a conventional configuration for a photoelectrophoretic imaging system which includes the roller electrode 1, transparent conductive electrode 2 and the imaging suspension 3 containing photosensitive pigment particles. An electric field is established across the suspension in the vicinity of the electrode nip by an appropriate electrical energy source 4. The suspension is exposed by the exposure mechanism 5 to radiation to which the electrically photosensitive pigments in the imaging suspension are sensitive. Mechanism 5 includes the lens 8 which focuses a light image of the original image 9 through the transparent injecting electrode 2 onto the suspension. An appropriate light source 10 generates the electromagnetic radiation. Typically a full frame positive image is formed on the conductive electrode 2 and a full frame optically negative image is formed on the blocking electrode, roller electrode 1. By rolling the blocking roller electrode 1 across the imaging suspension 3, the image is formed in a line by line fashion as the roller electrode rotates and translates over the transparent electrode while the light and field are applied.

Typically, the transparent conductive electrode 2 includes an optically transparent glass plate 13 coated on the imaging suspension side with an optically transparent layer of conductive material such as a thin layer of tin oxide. Electrodes of this type are typically termed "injecting electrodes" because the conductive layer provides an abundant source of charge carriers for exchanging charge with exposed photosensitive pigment particles of the imaging suspension. The roller blocking electrode 1 includes a conductive core 15 overcoated with a layer 16 of electrically insulating material. Electrodes of this type are typically termed "blocking electrodes" because the insulating layer provides few if any charge carriers for exchanging charge with photosensitive pigment particles residing thereon. The insulating layer 16 may be eliminated and photoelectrophoresis will still occur but its presence insures against electrical shortage between the electrodes in addition to improving image quality. Also, the transparent injecting electrode 2 may also be provided with a transparent electrically insulating layer over the tin oxide surface immediately adjacent the imaging suspension because charge carriers can be made available to the exposed electrically photosensitive pigment particles fully in accordance with the prior art.

Figure 2:
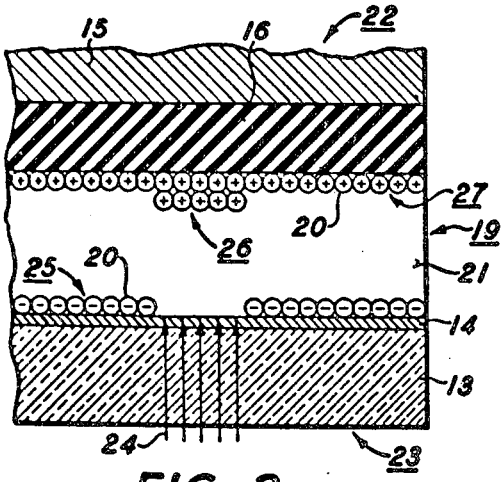
FIG. 2 is a schematic, sectional view in exaggerated proportions taken along lines 2—2 in FIG. 1 and illustrates the dark and light charged condition of prior art photoelectrophoretic systems which do not employ a dark charge injecting material on the blocking layer.

FIG. 2 illustrates the light induced image forming process of an exposed imaging suspension subjected to an electric field in accordance with the prior art, that is, in the absence of a dark charge injection step in the imaging process. It should be understood that this and the other drawings are intended to convey a functional understanding of the photoelectrophoretic process and the present invention. The physical models represented in the drawings are directed to that and are not intended to be theoretical explanations of the physical and chemical mechanisms involved. The relative sizes of the electrodes, imaging suspension and pigment particles therein are not to scale but are greatly exaggerated. The above mentioned and incorporated patents may be consulted for greater detail in that regard. For example, the usual particle size in the imaging suspension is from about 0.01 to about 20 microns and the gap between the electrodes occupied by the suspension is typically in the order of about 1 mil.

Suspension 19 of FIG. 2 includes the bipolar, electrically photosensitive pigment particles 20 and an electrically insulating liquid 21. The electric field established between electrodes 22 and 23 cause the positively charged pigment particles in the imaging suspension to be attracted toward electrode 22, which in this instance is taken to be negatively charged with respect to electrode 23. The negatively charged particles are thus attracted toward positively charged electrode 23. The amount or number of pigments attracted to the electrodes vary depending upon the nature, purity and type of pigments in the imaging suspensions. Although the distribution of particles is indicated to be approximately equal, such may not be the case in most instances. However, in many imaging suspensions of the prior art there are significantly high numbers of pigment particles which have too low a charge or are of the wrong polarity and hence are either not attracted at all or attracted to the blocking layer. The number is sufficiently high so as to substantially reduce the density of the particle layer on the conductive electrode 23. Lines 24 represent electromagnetic radiation of an image directed through transparent electrode 23 to the negatively charged pigment particle layer 25. Negative particles absorbing the radiation lose their excess charge and/or negative charge carriers to become positively charged and are thus attracted in the electric field toward negative electrode 22. The migrated particles 26 comprise an optically negative image of the original and the particles remaining on electrode 23 comprise an optically positive image of the original image. It is apparent from FIG. 2 that the pigment particles forming layer 27 on the blocking electrode 22 have remained there from the inception of the electrical field which attracted them. They remain there completely unaffected by the imaging operation. Thus at least two disadvantages of their presence in layer 27 are evident. First, they deprive the positive image of their contribution in terms of color balance in the polychrome system and in both monochrome and polychrome they deprive the positive image on electrode 23 of their contribution toward the density of the resulting image. Secondly, layer 27 provides unwanted background particles on the negative image residing on the blocking electrode 22. Such background is undesirable as it detracts from the qualities of the images thus produced.

Prior attempts at eliminating layer 27 included separating the steps of forming particle layer 25 and exposing the layer. That is, a second blocking electrode roller having a clean surface is passed over layer 25 so that particles 26 are deposited on a particle-free surface. The problem with this technique is that the particles in layer 25 are not always stable and/or bipolar particles are still present in sufficient quantities to form a particle layer similar to layer 27 on the clean roller surface. Obviously, an undesired second step is required in the prior art and the inefficient use of materials must be tolerated.

Figure 3:
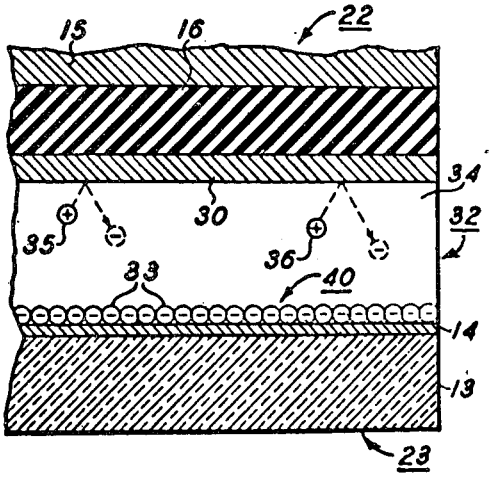
FIG. 3 is a schematic, sectional view in exaggerated proportion taken along lines 2—2 in FIG. 1 further including a dark charge injecting material on the blocking electrode in accordance with the process of this invention.

FIG. 3 illustrates a process of the present invention wherein the dark charge injecting material 30 resides on blocking layer 16. As explained previously, the application of an electric field between electrodes 22 and 23 causes the pigment particles of an imaging suspension to be attracted toward the electrode of opposite polarity to the charge acquired by the various pigment particles. Thus, layer 40 is formed on conductive electrode 23 which again is charged positively with respect to electrode 22 in the electrical field. The positively charged pigment particles of imaging suspension 32 are attracted toward negatively charged electrode 22. In FIG. 3 these are illustrated as particles 35 and 36 which upon coming in contact with the dark charge injecting material forming layer 30 become negatively charged and are thus attracted toward electrode 23 leaving the blocking layer free of pigment particle deposits. As mentioned above, the dark charge injecting material causes the pigment particles to acquire a charge of the same polarity as the electrode upon which the dark charge injecting material resides. The actual charge exchange mechanism is not presumed to be explained herein. Regardless of the mechanism involved, the positively charged particles become negative and join the originally negatively charged particles initially attracted to a transparent conductive electrode 23 to form layer 40. Ideally, all the particles in the suspension are attracted into and form layer 40 thereby increasing the potential maximum optical densities for the optical positive and negative images to be formed in the photoelectrophoretic imaging process. In addition, uniform deposition of the pigment particles increases the efficiency of the materials employed in the process and the color balance of a polychrome system is more easily achieved because one need not anticipate the loss of various amounts of differently colored pigments from the final image due to the erratic nature of charge acquisition of any one colored pigment in the imaging suspension.

Layer 40 is exposed in the conventional fashion as explained above with respect to the prior art photoelectrophoretic processes. A negative image is formed by particles attracted toward electrode 22 because of the action of appropriate electromagnetic radiation to which they are exposed as shown in FIG. 2. Of course, the negative image thus produced on electrode 22 does not contain undesirable background particles and the positive image remaining on electrode 23 benefits from the increased density otherwise lost by the previously positively charged pigment particles of the imaging suspension.

As explained above, materials useful for layer 30 are those materials which have a place in the Dark Charge Injection Series at least equal to any of the pigments employed in the imaging suspension. Otherwise stated, the pigments of the imaging suspension must be substantially no higher in the Dark Charge Injection Series than the material or pigment employed as the dark charge injecting material on the blocking layer. The choice of such materials for layer 30 can be independent of properties such as their relative spectral sensitivity with the pigment particles of the imaging suspension. As mentioned above, layer 30 may comprise pigment particles which are also employed in imaging suspension 32. Of course, those materials which do not provide results in terms of voltage at least equal to any of the generally recognized useful pigment particles for imaging suspension 32 could not be used in dark charge injecting layer 30. Otherwise it is simply a matter of associating the proper electrically photosensitive pigments in imaging suspension 32 with the appropriate dark charge injecting for use in layer 30.

The dark charge injecting materials of layer 30 can be applied to the blocking layer in many ways. The material can be dispersed in a carrier liquid and painted, dipped or rolled onto the surface of a blocking electrode. Upon drying, the dark charge injecting material is fixed to the blocking electrode such that it will not disperse into the imaging suspension during the photoelectrophoretic imaging process. The liquid employed in the imaging suspension should be coordinated with the dark charge injecting material on the blocking layer such that the liquid will not dissolve or loosen the dark charge injecting material on the blocking layer.

The preferred method for applying the dark charge injecting material is to include the material in the imaging suspension. Upon application of the electrical field, in the dark, the dark charge injecting material will plate out onto the blocking layer to form layer 30 and remain there during the imaging process.

Figure 4A:
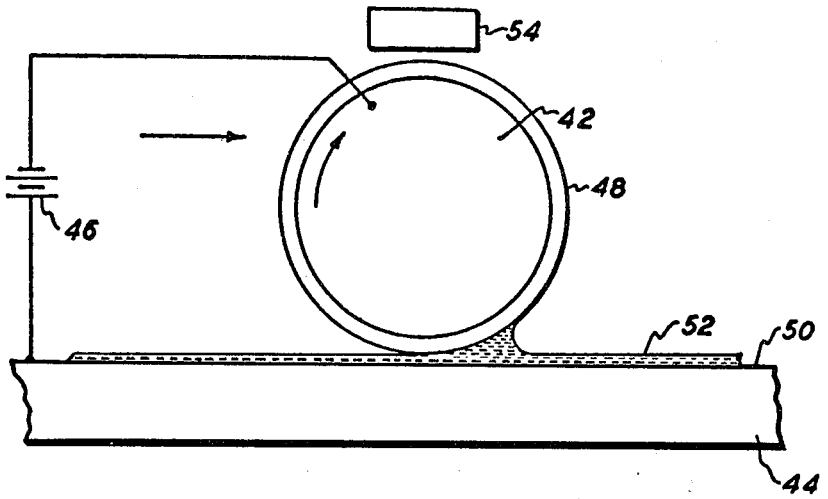
FIG. 4(a) is a schematic, side elevation view of a test system employed to place materials in the Dark Charge Injection Series.

As mentioned above, the Dark Charge Injection Series can be determined by a secondary test. In FIG. 4(a) there appears a schematic side elevation view of one system employed to place materials in the Series. A pair of electrodes, roller electrode 42 and conductive electrode 44, are connected to power source 46. Electrode 42 is coated with an electrically insulating blocking layer 48 which, in turn, carries a thin layer of the candidate material. (not shown) Liquid layer 52 is placed between blocking layer 48 and electrode 44. With the electric field placed between the electrodes, roller electrode 42 passes over liquid layer 52 while the system is in the dark. The candidate material on blocking layer 48 passes between the electrodes and is thus subjected to the above-mentioned electric field while in the dark. Without offering any theoretical explanation, the candidate material will carry an electric charge subsequent to being subjected to the electric field as described above. The amount of charge, expressed in volts, is measured by an electrometer or electrostatic voltmeter probe 54.

Figure 4B:
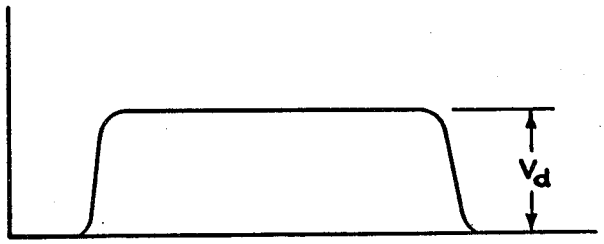
FIG. 4(b) is a graphical representation of data acquired by employing the system of FIG. 4(a).

In FIG. 4(b) is presented a graphical representation of the charge measured by probe 54. The ordinate indicates voltage measured and the abscissa indicates circumferential distance of the candidate material on blocking layer 48. As shown in FIG. 4(b), the amount of voltage $V_d$ indicates the dark injection voltage of the candidate material.

Any suitable material can be placed in the Series. The electrometer test described above is utilized by first coating a blocking material to a suitable thickness with a candidate material. The most preferred blocking material is Tedlar, an aluminized polyvinyl fluoride available from the E.I. duPont de Nemours & Co., Inc., the coated blocking material is utilized as the blocking electrode in a roller configuration which can take the form of the system of FIG. 4(a). The insulating liquid layer 52 is free of any pigment particles and can be any liquid previously known to be useful in the prior art photoelectrophoretic imaging system. A kerosene fraction, Sohio Odorless Solvent 3440 available from the Standard Oil Co., is the preferred electrically insulating liquid. The configuration comprising the coated blocking electrode 48, the clear liquid layer 52 and conductive electrode 44 is subjected to an electrical potential of about 1,000 volts. If the apparatus of FIG. 4(a) is employed, the roller blocking electrode traverses the conductive electrode at a rate of about 2–5 cm./second. The configuration is maintained in the dark condition while the electric potential is applied. The charge, in voltage, as measured on the coated blocking layer is detected by electrostatic voltmeter 54 as the roller electrode 42 travels across conductive electrode 44. The amount of voltage measured determines the place the candidate material occupies in the Dark Charge Injection Series.

The most reliable results are obtained in the above test when the dark charge injecting material is condensed on the blocking layer 48 after having been evaporated in a suitable vacuum chamber. Any method of coating such as electrophoretic deposition, solution coating and dip coating can be employed.

Through experience, the dark charge injection capability of any particular material has been found to be somewhat affected by the time duration of the electric field, the thickness of the dark charge injecting material coating on the blocking layer and the magnitude of the electric field. Generally speaking, the duration of the electric field will give some increase in the amount of dark charge injection but such duration does not appear to be affected in time durations of greater than 1 second. A duration of from $10^{-6}$ seconds to $10^{-1}$ second tends to increase the amount of dark charge injection. In most instances, the thickness of the dark charge injecting layer on the blocking electrode is in the range of from about 0.01 to about 10 microns, although other thicknesses can be employed. In general, the amount of dark charge injection increases with increasing thickness but above about 10 microns the amount of dark charge injection increase is small. While it has been found that the amount of the applied field increases the amount of dark charge injection, the amount of injection is generally sufficient for purposes of the photoelectrophoretic imaging process in the range of from about 100 to about 1,000 volts per mil although other fields can be employed. In actual practice, the operating conditions of the above described test are held constant to provide reproducable and comparable results.

The usefulness of any material in the process of this invention can be determined by a secondary test employing the apparatus described by FIG. 1. The apparatus of FIG. 1 is employed with an uncoated blocking electrode and the candidate material suspended in the imaging layer as the only particulate material. The candidate material is prepared and incorporated into the imaging layer in the same manner as is the electrically photosensitive pigments in the imaging suspension of a photoelectrophoretic imaging process. In other words, the photoelectrophoretic imaging process referred to above is practiced with the candidate material for the process of this invention employed as the imaging particles.

A series of images are obtained by exposing the imaging suspension to electromagnetic radiation to which the material is sensitive, said radiation being made through a gray scale step wedge. Each image is made with an increased voltage applied to the electrodes in the range of from about 100 volts to about 3,000 volts as the roller traverses the conductive electrode. The densities, D, of the images thus produced are then determined and plotted on a graph against the exposure, E, linearly, to provide a series of sensitivity curves for the candidate material. The initial slope of these curves, ($\Delta D/\Delta E$) are then plotted on a graph against the applied voltage to obtain a curve. Those materials useful in the process of this invention will provide data in accordance with the above described test which forms a curve wherein $\Delta D/\Delta E$) reaches a maximum and then decreases with increased voltage as shown by curve A of FIG. 5. Those materials providing data in accordance with the above described test resulting in a curve unlike curve A such as curve B of FIG. 5, are generally not useful as the dark charge injecting agent in the process of this invention.

Figure 5:
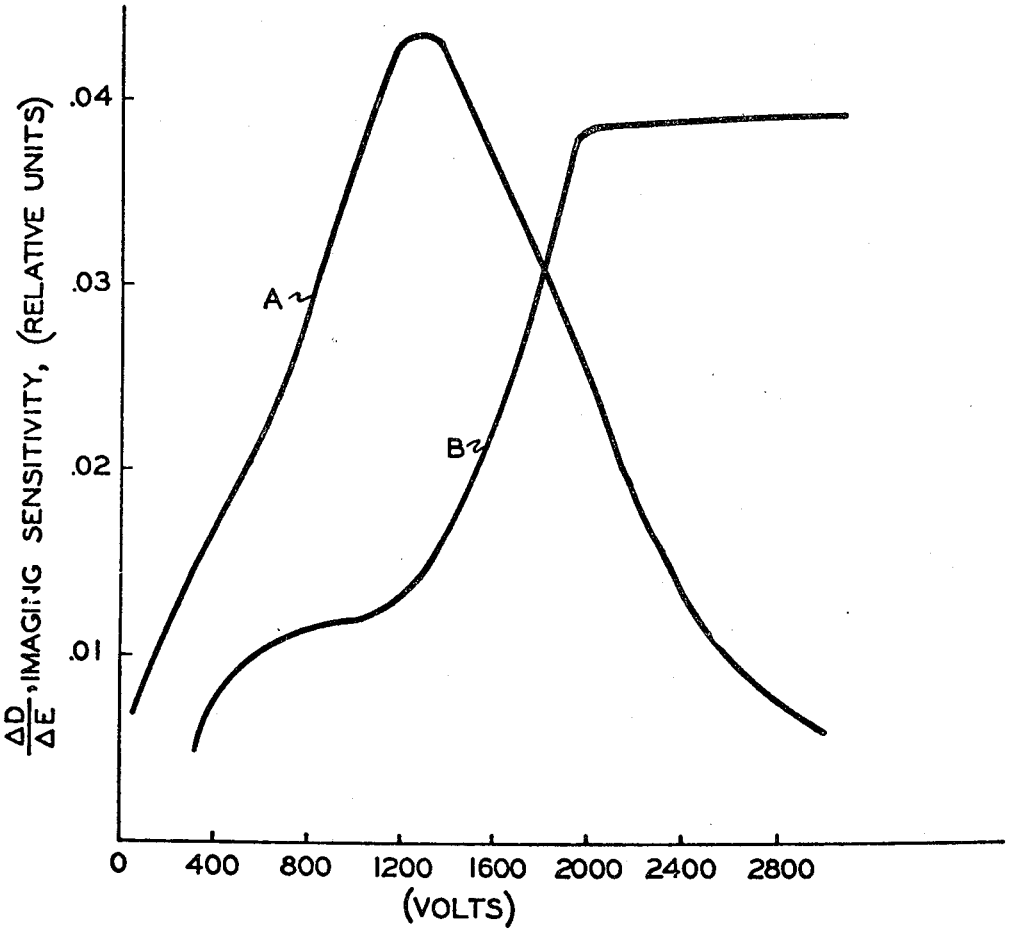
FIG. 5 is a graph showing the results of a test to determine the usefulness of materials in the process of this invention.

As shown in FIG. 5, the sensitivity of the dark charge injecting materials of this invention is lower at higher voltages indicating the effect of dark charge injection occurring in the imaging suspension by particles attracted to the blocking layer upon application of the electric field.

DESCRIPTION OF THE PREFERRED EMBODIMENTS

The following examples further specifically define the present invention. Parts and percentages are by weight unless otherwise indicated. The examples are intended to illustrate various preferred embodiments of the process of this invention.

All of the following examples are carried out in an apparatus of the general type illustrated in FIG. 1 with the imaging suspension being coated on the conductive surface of a NESA glass electrode connected in series with a switch, a potential source and a conductive center of a blocking electrode. The roller is about 2 ½ inches in diameter and is moved across the plate surface at about 4 cm./second. The conductive electrode employed is roughly a 4 inch square section of NESA glass and is exposed with an unfiltered white light intensity of about 200 microwatts/sq.cm. as measured on the uncoated NESA glass furface. Unless otherwise indicated about 7 percent by weight of the indicated pigments in each example is suspended in Sohio Odorless Solvent 3440 to form the imaging suspension. Exposure is made with a 3200°K lamp through a transparent photographic original while a potential of 2KV is applied between the electrodes. The dark charge injecting layer has a thickness on the blocking electrode in the range of about 0.05 to about 0.1 micron unless otherwise stated.

EXAMPLE I (Prior Art)

A trimix imaging suspension is prepared by combining equal amounts of Bonadur Red B having polymer added as described in Table I, metal-free alpha phthalocyanine, having polymer added by the same procedure as employed to add polymer to Bonadur Red B and yellow pigment N-2''-pyridyl-8,13-dioxodinaphtho-(2,1-d; 2',3-d) -furan-6-carboxamide with Sohio Odorless Solvent 3440 so as to make a substantially black imaging suspension. The thus prepared imaging suspension is coated on a NESA glass electrode. With 2,000 volts potential applied, a blocking electrode carrying a Tedlar film on its surface as a blocking layer is rolled over the imaging suspension while the imaging suspension is exposed to a full-color image. A low density optically positive image having poor color rendition is found on the NESA electrode while an optically negative image of the original is found on the blocking electrode. Also found on the blocking electrode is a substantially even coating of Bonadur Red B pigment derived from the uncoated material placed in the imaging layer.

EXAMPLE II

The procedure of Example I is repeated with the exception that there is added to the suspension an additional amount of uncoated Bonadur Red B pigment equal to about 10 percent of the original amount added. An optically positive image of improved density and proper color rendition is obtained on the NESA electrode while a dense optically negative image of proper color rendition is obtained on the blocking layer over a coating of Bonadur Red B pigment also on the blocking layer.

EXAMPLE III

The procedure of Example II is repeated with the exception that the excess 10 percent Bonadur Red B pigment is deleted from the imaging suspension. Instead, the Bonadur Red B pigment is suspended in Sohio Odorless Solvent 3440 at a concentration of about 4 percent, by weight. The suspension is painted onto a Tedlar film with a small brush. (Tedlar film is a polyvinyl fluoride film commercially available from the E. I. duPont de Nemours & Co.) Upon drying, the Tedlar film coated with Bonadur Red B pigment is employed as the blocking electrode. A very high density full color optically positive image is formed on the NESA electrode while an exceptionally high quality negative image is found on the blocking layer over the coating of Bonadur Red B.

EXAMPLE IV (Prior Art)

An imaging suspension is prepared by suspending the yellow pigment of Example I in Sohio Odorless Solvent 3440. The suspension is coated on the tin oxide surface of a NESA electrode, and while being exposed to actinic electromagnetic radiation the layer is subjected to an electric field by means of a roller electrode as described in FIG. 1 above. The image produced exhibits a very low maximum density (blue reflection density less than 0.05) on the NESA electrode while the negative image on the blocking layer indicates high background.

EXAMPLE V

A color balanced imaging suspension is prepared which comprises amounts of the yellow pigment of Example I and alpha phthalocyanine to provide an imaging suspension which appears green to the eye. The imaging suspension is coated on the tin oxide surface of a NESA electrode and subjected to a two-color imagewise exposure while subjected to an electrical field. An optically positive two-color image appears on the blocking layer. The positive image appears deficient in cyan pigment while the negative image contains excess cyan.

EXAMPLE VI

The procedure of Example V is repeated with the exception that alpha phthalocyanine is coated onto a Tedlar film with a small brush from a suspension in Sohio Odorless Solvent 3440 and dried. The coated Tedlar film is exposed as the blocking layer on the roller electrode allowing the alpha phthalocyanine coating to come into contact with the imaging suspension with the electrical field applied. The images obtained have superior color rendition and density.

EXAMPLE VII

A trimix is prepared by combining amounts of a magenta pigment, 1-[1-naphthyl azo]-2-naphthol, polymer treated alpha phthalocyanine and the yellow pigment of Example I to obtain a color balanced black suspension. To the substantially black appearing imaging suspension there is added a 10 percent excess of the magenta pigment based upon the initial weight of that pigment. The imaging suspension is then coated on the conductive surface of a NESA electrode and exposed to a full-color original image while a roller blocking electrode is roller over the suspension as described in FIG. 1 above. There is thus provided a dense high quality full-color positive image on the NESA electrode and a dense negative image on the blocking layer over a thin continuous coating of the magenta pigment of the imaging suspension.

EXAMPLE VIII

The procedure of Example VII is repeated with the exception that the excess magenta pigment is coated onto a Tedlar film and dried instead of being added to the imaging suspension. The Tedlar film is employed as the insulating layer on the blocking electrode allowing the dried film to come into contact with the imaging suspension during the imaging process. Results similar to that obtained in Example VII are observed on the NESA and blocking electrodes.

Although specific components and proportions have been stated in the above description of preferred embodiments of the invention, other typical materials as listed above if suitable may be used with similar results. In addition, other materials may be added to the mixture to synergize, enhance or otherwise modify the properties of the imaging layer. For example, various dyes, spectral sensitizers such as Lewis acids may be added to the several layers.

Other modifications and ramifications of the present invention will occur to those skilled in the art upon a reading of the present disclosure. These are intended to be included within the scope of this invention.

What is claimed is:

1. A photoelectrophoretic imaging process comprising the steps of providing an imaging layer comprising a suspension of particles of at least one electrically photosensitive pigment in a carrier liquid placed between a conductive electrode and a blocking electrode, said conductive electrode being at least partially transparent to electromagnetic radiation to which at least a portion of said pigment particles are sensitive and said blocking electrode being coated with a dark charge injecting agent selected from the group consisting of Bonadur Red B, 1-[1-naphthyl azo]-2-naphthol, alpha phthalocyanine, benzo-[b]-naphtho-[2,3-d]-furan-6,11-dione and dinaphtho-[1,2-b; 2′,3′-d]-furan-8,13-dione, one pigment in said imaging layer being the same material as said dark charge injecting agent and wherein, when measured as described in the accompanying specification said dark charge injecting agent coating exhibits a higher voltage than any of said at least one pigment which are not the same material as said dark charge injecting agent, subjecting said suspension to an electrical field in the dark while in contact with said dark charge injecting agent whereby said pigment particles are substantially uniformly attracted to said conductive electrode, exposing said suspension to imagewise electromagnetic radiation to which at least a portion of said pigment particles are sensitive until an image is formed.

2. The method of claim 1 wherein said imaging suspension comprises pigments of at least two colors and having different spectral sensitivity.

3. The method of claim 1 wherein said imaging suspension comprises three different electrically photosensitive pigments each pigment being responsive to a different wavelength of electromagnetic radiation.

4. The method of claim 1 wherein the imaging suspension includes cyan colored particles which are principally photosensitive to red light, magenta colored particles which are principally photosensitive to green light, and yellow colored particles which are principally photosensitive to blue light.

5. The method of claim 1 wherein said dark charge injecting agent is first coated on the blocking layer and fixed thereto before being placed in contact with said imaging layer.

6. The method of claim 1 wherein the dark charge injecting agent is initially included in said imaging layer in addition to said electrically photosensitive pigment and said dark charge injecting agent is attracted to said blocking layer by the application of an electrical field while said imaging layer is held in the dark condition.

7. The method of claim 5 wherein said dark charge injecting agent is vacuum evaporated onto said blocking layer.

8. The method of claim 5 wherein said dark charge injecting agent is coated onto said blocking layer from a liquid dispersion.

9. The method of claim 5 wherein said blocking layer is coated with said dark charge injecting agent by dipping said blocking layer into a suspension of said dark charge injecting agent.

10. The method of claim 1 wherein the dark charge injecting layer has a thickness in the range of from about 0.01 micron to about 10 microns.

11. The method of claim 1 wherein the dark charge injecting agent is Bonadur Red B.

12. The method of claim 1 wherein the dark charge injecting agent is 1-[1-naphthyl azo]-2-naphthol.

13. The method of claim 1 wherein the dark charge injecting agent is selected from the group consisting of benzo-[b]-naphtho-[2,3-d]furan-6,11-dione; alpha phthalocyanine and dinaphtho [1,2 b; 2',3'd] furan-8,13 dione.

14. The method of claim 1 wherein the imaging suspension is exposed to an optically negative image thereby providing an optically positive copy on said blocking layer.

15. The method of claim 14 wherein said imaging suspension comprises three different electrically photosensitive pigments, each pigment being responsive to a different wavelength of electromagnetic radiation.

16. The method of claim 15 wherein the imaging suspension includes cyan colored particles which are principally photosensitive to red light, magenta colored particles which are principally photosensitive to green light, and yellow colored particles which are principally photosensitive to blue light.

17. The method of claim 14 wherein the dark charge injecting agent is 1-[1-naphthyl azo]-2-naphthol.

18. The method of claim 14 wherein the dark charge injecting agent is Bonadur Red B.

* * * * *